US005765582A

United States Patent [19]

Molnar, IV

[11] Patent Number: 5,765,582

[45] Date of Patent: Jun. 16, 1998

[54] TABLE UMBRELLA APPARATUS

[76] Inventor: William F. Molnar, IV, 1535 Almond Brook La., Houston, Tex. 77062

[21] Appl. No.: 614,489

[22] Filed: Mar. 13, 1996

Related U.S. Application Data

[63] Continuation-in-part of Ser. No. 513,272, Aug. 10, 1995, abandoned.

[51] Int. Cl.[6] ..... A45B 3/00

[52] U.S. Cl. ..... 135/16; 135/31; 135/33.2; 416/132 A

[58] Field of Search ..... 135/16, 25.1, 31, 135/33.2, 33.7, 24; 416/132 A, 196 R, 142, 169 R

[56] References Cited

U.S. PATENT DOCUMENTS

| | | | |
|---|---|---|---|
| 1,148,332 | 7/1915 | Onyskow . | |
| 1,387,740 | 8/1921 | Stevens . | |
| 1,532,802 | 4/1925 | Feistner . | |
| 2,729,220 | 1/1956 | Smyrnow . | |
| 3,102,547 | 9/1963 | Domina . | |
| 3,177,881 | 4/1965 | Covington . | |
| 3,401,874 | 9/1968 | Covington . | |
| 3,444,799 | 5/1969 | Covington . | |
| 4,132,236 | 1/1979 | Petersen . | |
| 4,823,821 | 4/1989 | Day | 135/24 |
| 5,007,811 | 4/1991 | Hopkins . | |
| 5,110,261 | 5/1992 | Junkin . | |
| 5,273,062 | 12/1993 | Mozdzanowski . | |
| 5,287,869 | 2/1994 | Wu . | |
| 5,387,048 | 2/1995 | Kuo | 135/25.1 X |

*Primary Examiner*—Lanna Mai
*Attorney, Agent, or Firm*—Harrison & Egbert

[57] ABSTRACT

A table umbrella apparatus including a tubular support member, a hub rotatably mounted at an end of the tubular support member, a fan extending radially outwardly of the hub so as to be in the form of a table umbrella, and a motor connected to the hub for rotating the fan about a longitudinal axis of the tubular support member. A shaft is connected to the motor and is connected to the hub. The shaft extends longitudinally along an interior of the tubular support member. The shaft is supported by bearings interior of the tubular support member. A base is connected to the bottom of the tubular support member so as to support the tubular support member in a vertical orientation. A table is supported around the tubular support member in a horizontal plane. The fan has a plurality of fan blades. Each fan blade has a wire frame having one end connected to the hub and extending outwardly therefrom and a covering extending over the wire frame.

9 Claims, 8 Drawing Sheets

TABLE UMBRELLA APPARATUS

RELATED APPLICATIONS

The present application is a continuation-in-part of U.S. patent application Ser. No. 08/513,272, filed on Aug. 10, 1995, and entitled "TABLE UMBRELLA APPARATUS", now abandoned presently.

TECHNICAL FIELD

The present invention relates to table umbrellas, generally. More particularly, the present invention relates to fans that can be utilized on patios above patio tables. More particularly, the present invention relates to table umbrellas in which the umbrella can rotate above the table.

BACKGROUND ART

In many areas of the world, large umbrellas are used in conjunction with tables for the purpose of providing shade while dining or drinking outdoors. Heat and/or insects often reduce significantly an individual's capacity to enjoy outdoor leisure activities.

Various items have been employed in the past in conjunction with outdoor patio activities. In particular, electric fans have been used as a source of air for those sitting outside.

Electric fans commonly use an electric motor with fan blades attached to the shaft of the rotor of the motor such that the electric motor is positioned central to the fan blades. Unfortunately, when the fan blades are used outside, they do not provide a great deal of protection from the sun.

In the past, various table umbrella apparatus have employed a variety of fan blade constructions. However, it is often desirable to provide such a table umbrella apparatus of moderate expense. As such, a need has developed for providing a table umbrella apparatus which can be manufactured inexpensively while still providing a downdraft of air to persons sitting below the table umbrella apparatus.

It is an object of the present invention to provide a table umbrella apparatus in which the umbrella provides a breeze and shade to those sitting at the table.

It is another object of the present invention to provide a table umbrella apparatus in which the fan can open and close in the manner of a conventional table umbrella.

It is a further object of the present invention to provide a table umbrella apparatus in which the rotating machinery can be stored within the conventional tubular structure and base of a conventional table umbrella.

It is still a further object of the present invention to provide a table umbrella apparatus which employs a rotatable "umbrella" which is safe and effective.

It is still another object of the present invention to provide a table umbrella apparatus in which the speed of rotation of the umbrella can be controlled.

It is still another object of the present invention to provide a table umbrella apparatus which is relatively inexpensive, easy to manufacture, and easy to use.

These and other objects and advantages of the present invention will become apparent from a reading of the attached specification and appended claims.

SUMMARY OF THE INVENTION

The present invention is a table umbrella apparatus that comprises a tubular support member, a hub rotatably mounted at one end of the tubular support member, a fan extending radially outwardly of the hub in the form of a table umbrella so as to cause a downdraft of air upon a rotation of the fan, and a rotation means connected to the hub for rotating the fan about a longitudinal axis of the tubular support member. A shaft is connected to the rotation means and connected to the hub. The shaft extends longitudinally along an interior of the tubular support member.

The shaft is supported by bearings interior of the tubular support member. The shaft is connected to the rotation means at one end and to the fan at the opposite end. The shaft can include, in one embodiment, a first shaft portion connected to the rotation means at one end, and a second shaft portion connected to the hub at one end. The second shaft portion is in clutched connection with the first shaft portion.

The tubular support member can include, in one embodiment, a first tubular member, and a second tubular member telescopically connected to an end of the first tubular member. One of the first and second tubular members has a greater diameter than the other of the tubular members. In one embodiment of the present invention, a connecting pin can be affixed to one of the tubular members and removably received within a hole in the other tubular member. The hole extends through a wall of such tubular member.

In the present invention, a base is connected to a bottom of the tubular support member. This base supports the tubular support member in a vertical orientation.

The rotation means of the present invention includes a motor mounted in this base. A transmission interconnects the motor to the shaft. The shaft will extend into the base. The transmission includes a pulley connected to the motor by a drive belt, a worm gear extending axially outwardly from the pulley and rotatable with respect to a rotation of the pulley, and a drive gear in toothed connection with the worm gear. The drive gear is connected to the shaft such that the shaft extends axially upwardly therefrom. The drive gear is rotatable relative to a movement of the worm gear. The motor can include an AC motor having a drive shaft connected to the drive belt. A power supply cord is connected to the AC motor and extends outwardly of the base. This power supply cord allows the motor to be connected to a power supply, such as an AC outlet.

A table is supported around the tubular support member.

This table extends radially in a horizontal plane from the tubular support member. The table is positioned below the plurality of fan blades.

In one embodiment of the present invention, the fan includes a plurality of fan blades. Each of the plurality of fan blades includes a wire frame having one end connected to the hub and extending outwardly therefrom, and a covering extending over the wire frame. The wire frame is hingedly connected to the hub. Each of the plurality of fan blades can further include an eyelet mounted to the wire frame and extending outwardly of the cover, and a support cable connected at one end to the hub and detachably connected to the eyelet at the other end. The support cable serves to support each of the plurality of fan blades in a tilted open umbrella fashion with respect to the tubular support member. The plurality of fan blades is selectively movable between an open position extending radially outwardly of the hub and a closed position adjacent the tubular support member. A canopy is supported above the hub and extends outwardly over the plurality of fan blades. If needed, a speed control mechanism can be connected to the motor so as to control the rate of rotation of the fan blades.

In another embodiment of the present invention, the fan includes a disk member which is affixed to the hub. The disk member has a vent affixed thereto so as to pass air downwardly through the disk member. In particular, the vent includes a first vent adjustably hingedly connected to the disk member and a second vent adjustably hingedly connected to the disk member. The second vent is positioned approximately 180° from the first vent around the hub.

In still a further embodiment of the present invention, the fan includes a plurality of fan blades which are hingedly connected to the hub, a tubular bracket slidably disposed over the tubular support member, and a plurality of struts hingedly connected to the tubular support bracket. Each of the plurality of struts is hingedly connected to one of the plurality of fan blades. In this embodiment, each of the plurality of struts includes a first strut segment hingedly connected at one end to the tubular support bracket and a second strut segment hingedly connected at one end to one of the plurality of fan blades. A locking hinge is connected to an opposite end of the first strut segment and to an opposite end of the second strut segment. This locking hinge serves to linearly align the first and second strut segments and to fix these first and second strut segments in linear alignment. Additionally, in this embodiment, each of the plurality of fan blades includes a first wire frame member hingedly connected to the hub, a second wire frame member hingedly connected to the hub, and a locking hinge having one end hingedly connected to the first wire frame member and an opposite end hingedly connected to the second wire frame member. The locking hinge serves to fixedly separate the first wire frame member from the second wire frame member. A covering extends between these wire frame members. The tubular bracket is selectively movable between a first fan blade lifting position and a second fan blade lowering position. The tubular bracket is lockable onto the tubular support member in at least one of these first and second positions.

DETAILED DESCRIPTION OF THE INVENTION

Figure 1:
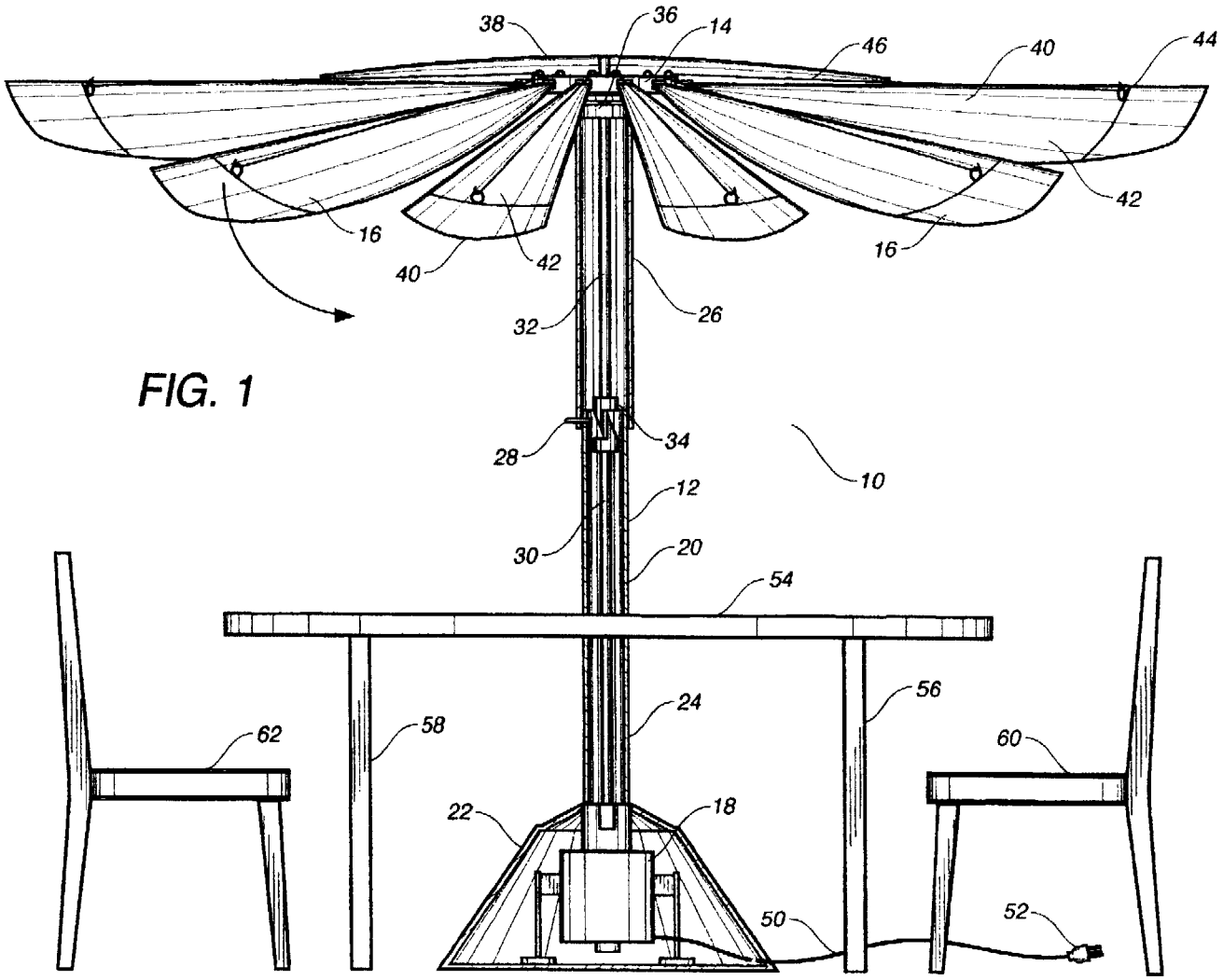
FIG. 1 is a side elevation view, in partial cross-section, of the table umbrella apparatus of the present invention.

Referring to FIG. 1, there is shown at 10 the table umbrella apparatus in accordance with the preferred embodiment of the present invention. The table umbrella apparatus 10 includes a tubular support member 12, a hub 14, a plurality of fan blades 16, and a motor 18. In particular, the hub 14 is rotatably mounted on an upper end of the tubular support member 12. The plurality of fan blades 16 extend radially outwardly at a tilted angle of the hub 14. The plurality of fan blades are generally in the form of a table umbrella. The motor 18 is connected by a shaft 20 to the hub 14. The motor 18, mounted in the base 22, of the table umbrella apparatus 10 serves to rotate the plurality of fan blades 16 about the longitudinal axis of the tubular support member 12.

In FIG. 1, the tubular support member includes a first tubular member 24 and a second tubular member 26. The first tubular member 24 is arranged in a telescopic arrangement with the second tubular member 26. As can be seen, the second tubular member 26 has a greater diameter than that of the first tubular member 24. A pin connector 28 is affixed to the interior of the first tubular member 24 and extends through a hole formed in the wall of the second tubular member 26. When it is desired to separate the second tubular member 26 from the first tubular member 24, the connecting pin 28 is pushed inwardly so as to free the sections of the tubular support member 12.

The shaft 20 extends to the interior of the tubular support member 12. In the embodiment shown in FIG. 1, the shaft 20 includes a first shaft portion 30 and a second shaft portion 32. The first shaft portion 30 is in clutched connection at 34 to the second shaft portion 32. The clutch is provided so that the fan blades 16 can be released from engagement with the motor 18. As such, the present invention enhances the safety of the rotating blade 16. The shaft 20 is connected, at one end, to the motor 18 and is connected, at the other end, to the hub 14. The shaft 20 is supported by bearings 36 adjacent the upper portion of the second tubular member 26. The shaft 20 also is connected to a canopy 38 at its upper end. The canopy 38 extends outwardly over the hub 14 and over a portion of the fan blade 16. The canopy 38 is attached by hook-and-loop material to the loading edge of the blade 16 and rotates with the hub 14. The canopy 38 will collapse adjacent to the shaft 20 when in the closed position. Alternatively, the canopy 38 can be permanently attached to the top of the shaft 20. It can be made of fiberglass or of solid material and does not move with the hub 14. It would not collapse but could be removed. In the configuration shown in FIG. 1, the shaft 20 is free to rotate on the interior of the tubular support member 12 so as to cause the rotation of the hub 14.

The hub 14 is rotatably mounted at the upper end of the second tubular portion 26. The hub 14 is connected to the shaft 20 such that the hub 14 will rotate with the rotation of the shaft 20. The plurality of fan blades 16 are connected, at one end, to the hub 14.

Each of the fan blades 16 includes a wire frame 40 which has one end connected to the hub 14 in hinged relationship therewith. The wire frame 40 extends outwardly of the hub 14 such that each of the fan blades is at a tilted angle with respect to the horizontal. A fabric covering extends over this wire frame so as to cover the wire frame. An eyelet 44 is mounted to the wire frame 40 and extends outwardly of the cover. A support cable 46 is connected at one end to the hub 14 and detachably connected, at the other end, to the eyelet 44. This support cable serves to support each of the plurality of fan blades in an open umbrella fashion outwardly of the tubular support member 12 and radially outwardly of the hub 14.

Since each of the wire frames 40 is hingedly connected to the hub 14, the fan blades 16 will move from an open position in which the blades 16 extends outwardly radially of the hub 14 to a position in which the blades 16 are adjacent the outer surface of the tubular support member 12. In order to move the blades to this position, it is only necessary to unhook the support cable 46 from the eyelet 44. As such, the present invention provides for simple installation of the fan portion of the apparatus. The fan blades 16 can be constructed out of various materials other than metal.

The motor 18 is described in greater detail in connection with FIG. 3. The motor 18 is mounted within the base 22. The base 22 maintains the tubular support member 12 in a vertical orientation. The use of the motor 18 in the base 22 provides ballast to the base 22. A cord 50 is connected to the motor 18 and extends outwardly of the base 22. The cord 50 includes a plug 52 that allows the motor 18 to be connected to a source of power. A table 54 is supported around the tubular support member 12. This table extends radially in a horizontal plane from the tubular support member 12. The table 54 is positioned below the plurality of fan blades 16. Legs 56 and 58 are shown as supporting the table 54. In FIG. 1, chairs 60 and 62 are shown in an approximate location relative to the table 54. It is important to note that the table 54 provides stability but is not always necessary for the purposes of the present invention. The device 10 could stand alone by the weight of the base or attached to the surface.

In normal use, when the motor 18 is turned on, the motor 18 will rotate the shaft 20 so as to rotate the hub 14 and to rotate the fan blades 16. If the fan blades 16 should encounter an obstacle, the clutch 34 will cause the shaft portions 32 and 30 to separate so as to prevent any damage and destruction by the fan blades 16. Additionally, the pitch of the fan blades 16 in relation to the hub forces are downward. The fan blade position is an added safety precaution in that rotational travel of the blade's leading edge is pitched upward such that a person is more unlikely to touch its travel. Generally, the construction of the fan blades should be safe for those using the fan blades. When it is desired to disassemble the table umbrella 10, it is only necessary to disconnect the support cables 46 from the eyelets 44 such that the fan blades 16 will hinge downwardly from the hub 14 and rest against the surface of the second tubular member 26. Additionally, the second tubular member 26 can be disconnected from the first tubular member 24 by pressing the connecting pin 28 inwardly. This will allow the components to be separated for disassembly and storage, as needed.

Figure 2:
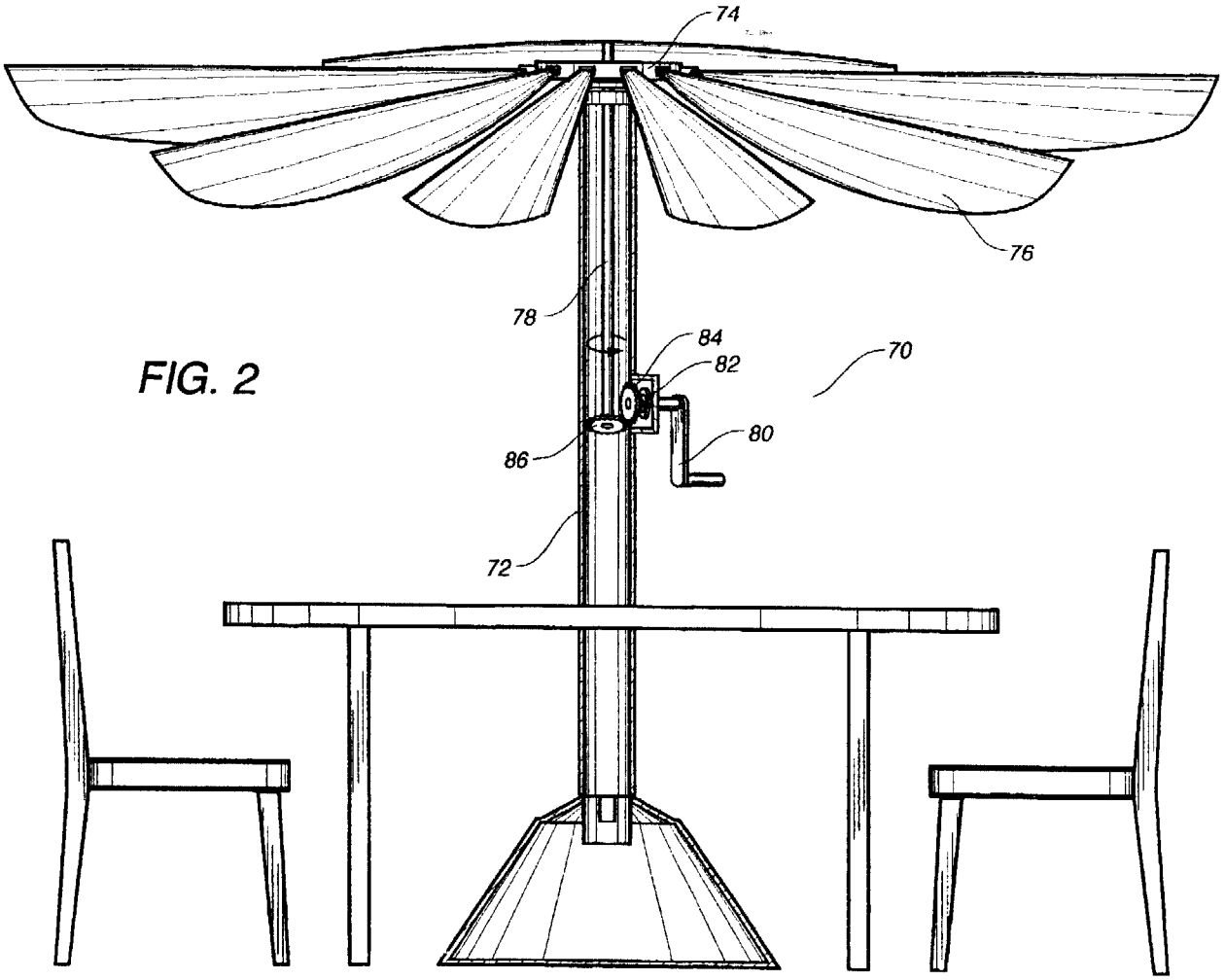
FIG. 2 is a side elevational view, in partial cross-section, of the table umbrella apparatus in accordance with the simplest embodiment of the present invention.

FIG. 2 shows an alternative embodiment 70 of the tubular member apparatus of the present invention. Table umbrella apparatus 70 is the simplest form of the present invention. Table umbrella apparatus 70 includes a tubular support member 72, a hub 74, fan blades 76, and a shaft 78. The shaft 78 is connected to the hub 74 and extends downwardly through the interior of the tubular support member 72. A crank 80 is connected to a resilient spring 82 within a housing 84 mounted to the exterior surface of the tubular support member 72. A second gear 86 is mounted to the end of the shaft 78 within the interior of the tubular support member 72. The first gear 84 will engage the second gear 86 in a toothed relationship. The crank 80 can be turned so as to rotate the fan blades 76 or to wind up the spring 82 such that the spring will cause a rotation of the first gear 84 in a controlled watch-like manner. As such, the fan blades 76 will continue to rotate as the spring 82 unwinds.

Figure 3:
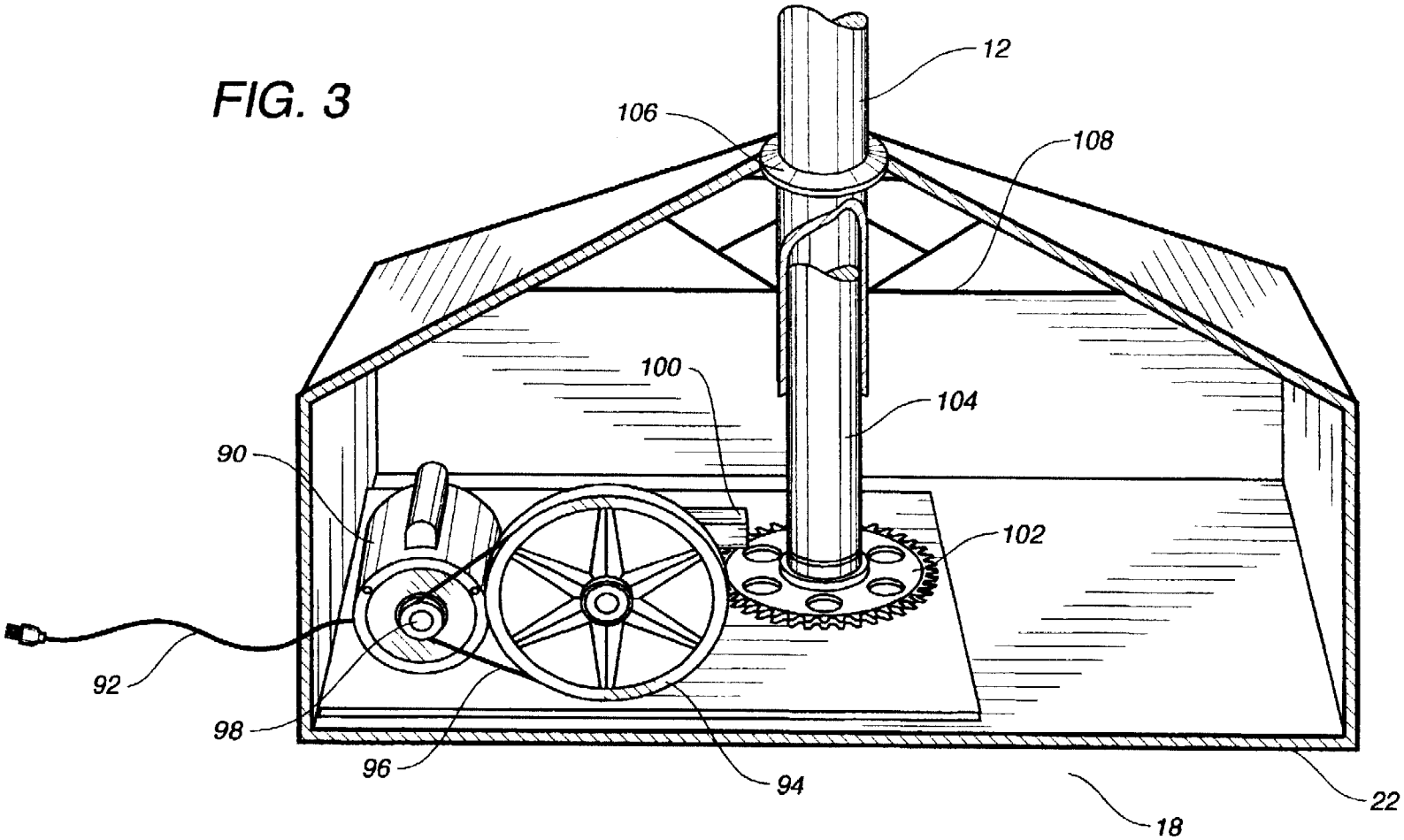
FIG. 3 is a diagrammatic illustration of the con figuration of the motor and transmission as connected to the drive shaft within the base of the present invention.

FIG. 3 is a detailed illustration of the motor 18 of the present invention. The motor 18 is mounted within the base 22 of the table umbrella apparatus of the present invention. The motor 18 includes an AC motor 90 which has a cord 92 extending outwardly therefrom. A pulley 94 is connected to the motor 90 by a drive belt 96. The drive belt 96 extends from the shaft 98 of motor 90 and around the outer diameter of the pulley 94. A worm gear 100 extends axially outwardly from the pulley 94. This worm gear 100 is rotatable with a rotation of the pulley 94. A drive gear 102 is in toothed connection with the worm gear 100. The drive gear 102 is connected to a drive shaft 104 such that the drive shaft 104 extends axially upwardly therefrom. The shaft 104 is shown as extending interior of the tubular support member 12. A grommet 106 establishes a liquid-tight seal between the outer surface of the tubular support member 12 and the top of the base 22. Support brackets 108 are provided on the interior of the base 22 to give strength and support to the position of the tubular support member 12. The motor 18 is configured so as to gear down the speed of the motor through the use of the transmission indicated by the pulley 94, the worm gear 100, and the drive gear 102. Various motors are useful for the purposes of the present invention. For example, gear motors with built-in transmissions can be used. Also, "universal" motor types that allow for control of the speed and are rated for a given torque range can be used. The present invention is not intended to be limited to the specific motor configuration described herein.

Figures 4, 5, 6:
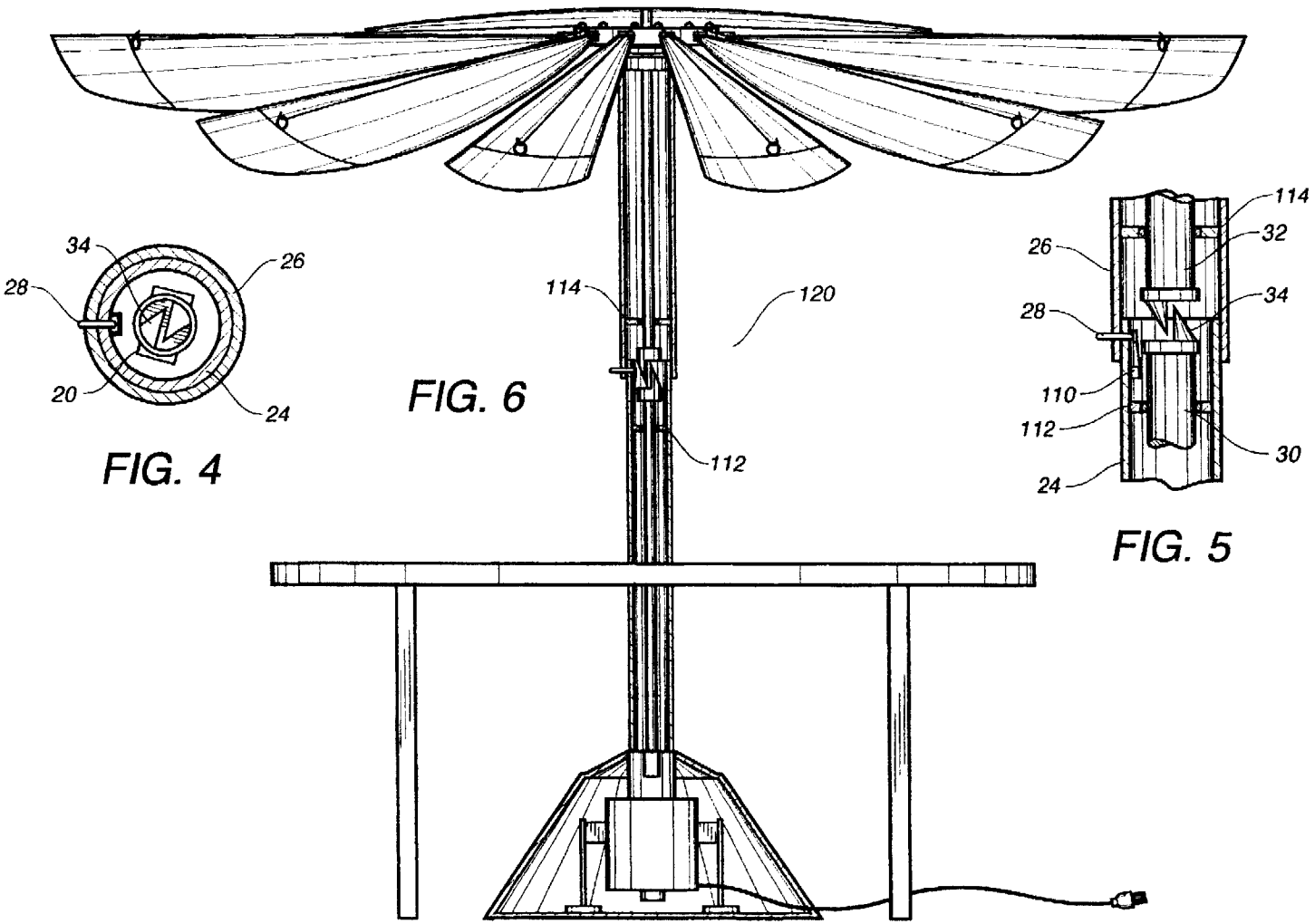
FIG. 4 is a cross-sectional view showing the interaction of the tubular members and the clutch connection between the shaft portions of an alternative embodiment of the present invention.
FIG. 5 is a cross-sectional side view of the configuration of FIG. 4.
FIG. 6 is a side elevational view, in partial cross-section, of a first alternative embodiment of the present invention.

FIG. 4 illustrates the configuration of the first tubular member 24 with respect to the second tubular member 26. As can be seen, the connecting pin 28 extends through the walls of the tubular members 24 and 26 so as to secure such tubular members together in their telescoped arrangement. The shaft 20 is illustrated as having clutching mechanism 34 formed therein. The clutch mechanism 34 is suitable for allowing the separation of the first shaft portion 30 from the second shaft portion 32 when an obstruction is encountered by the fan blades 16. A spring tensioner is placed on one of the protrusions so as to allow it to collapse or recess into or flat against the shaft so as to disengage one protrusion from the other.

FIG. 5 is a more detailed view of the configuration of the clutch mechanism. In FIG. 5, the first tubular member 24 is shown as having a smaller diameter than the second tubular member 26. Pin 28 is shown as extending through the walls of these tubular members. The pin 28 is secured by strut 110 to the inner wall of the first tubular member 24. The first tubular member 24 includes a bearing support 112 which is fixed to the interior of the first tubular member 24 and surrounds the exterior surface of the first shaft portion 30. The second tubular portion 26 includes a bearing support 114 affixed on the interior of the second tubular portion 26 so as to surround the exterior surface of the second shaft portion 32. Clutch 34 is a one way clutch which provides a safety release and allows the upper shaft portion 32 to be separated from the lower shaft portion 30 for the breakdown of the system.

FIG. 6 shows an alternative embodiment 120 of the present invention. In this alternative embodiment 120, the particular arrangement of the tubular portions 24 and 26 and the shaft portions 30 and 32 are illustrated. Additionally, the configuration shown in FIGS. 4 and 5 is integrated into the alternative embodiment 120. Alternative embodiment 120 shows, in particular, the additional bearing supports 112 and 114 positioned on the interior of the tubular portions.

Figure 7:
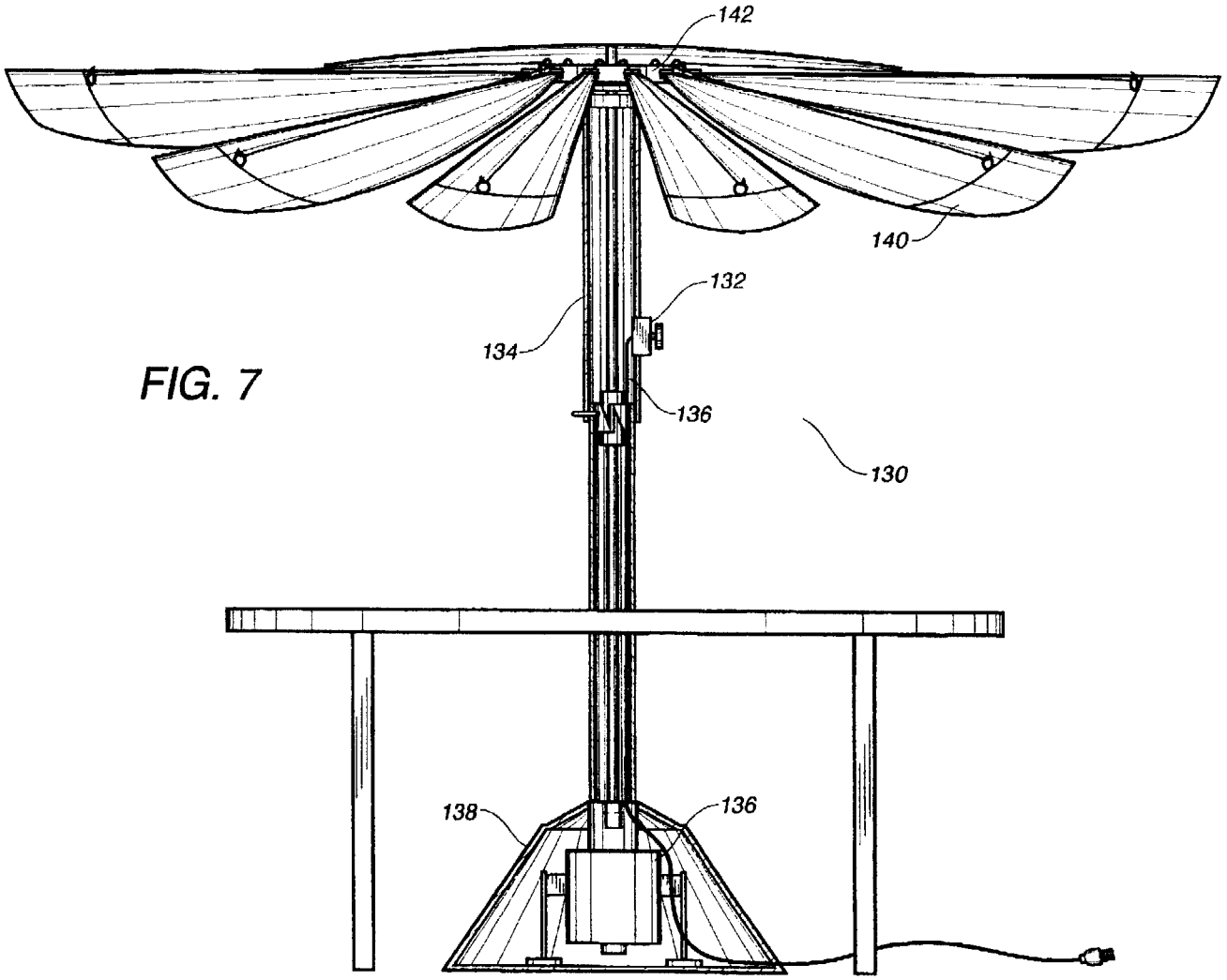
FIG. 7 is a side elevational view, in partial cross-section, of a second alternative embodiment of the present invention.

FIG. 7 shows another alternative embodiment 130 of the present invention. This alternative embodiment 130 includes a speed control mechanism 132 which is mounted to an exterior surface of the tubular member 134. A wire 136 extends downwardly through the interior of the tubular member 134 so as to act on the motor 136 in the base 138. As such, the switch 132 is suitable for controlling the speed of rotation of the fan blades 140 and the hub 142. In essence, the speed control switch 132 is in the form of a "dimmer" switch.

Figures 8, 9:
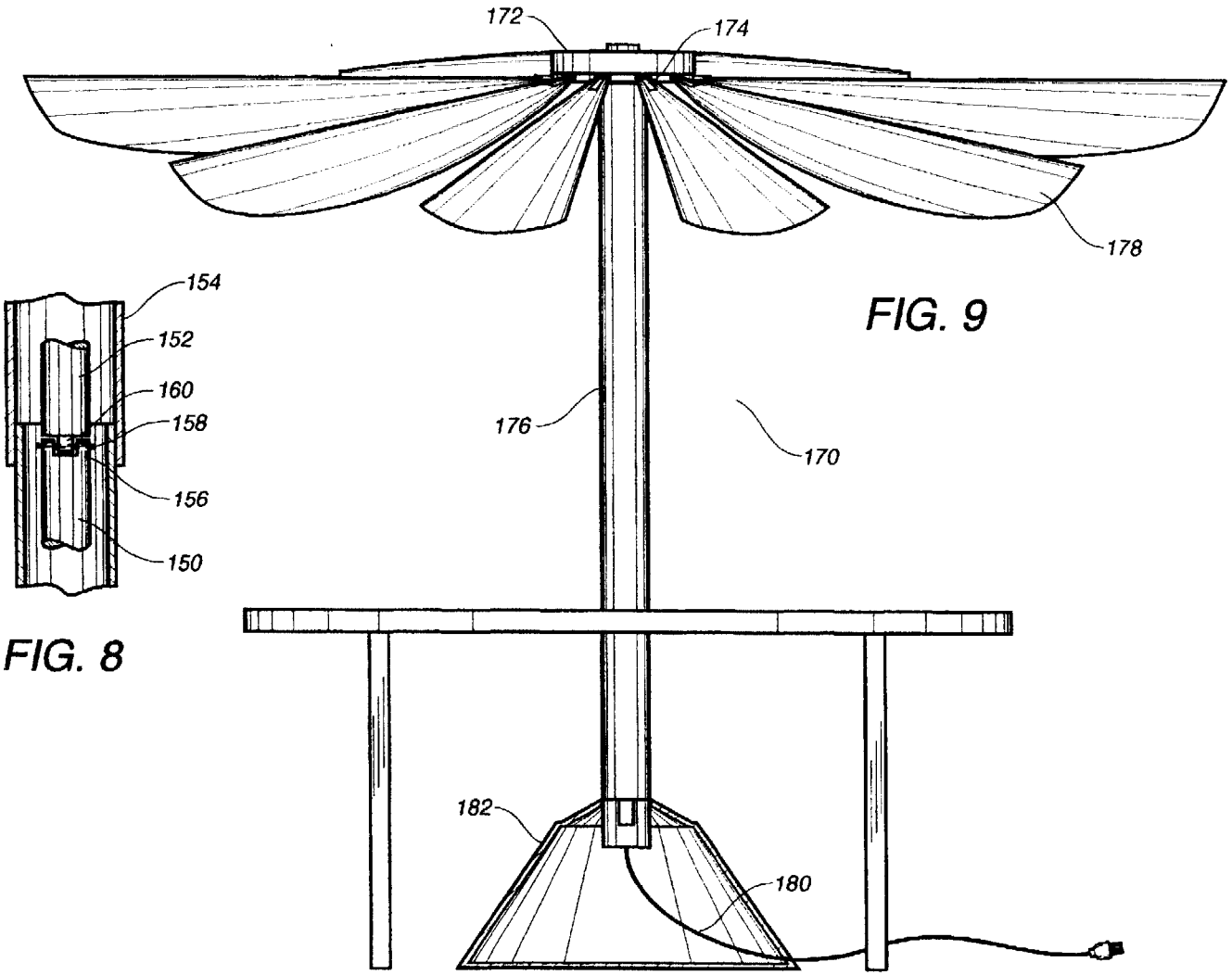
FIG. 8 is a cross-sectional view of the connection of a two portion shaft used in an alternative embodiment of the present invention.
FIG. 9 is a side elevational view of a third alternative embodiment of the table umbrella apparatus of the present invention.

FIG. 8 shows an alternative embodiment of the connection of the shaft portions. In FIG. 8, shaft portion 150 is connected to shaft portion 152 within the interior of the tubular support member 154. Importantly, at the upper end of the first shaft portion 150 is a U-joint 156. The U-joint 156 serves to receive a pin 158. Pin 158 will extend through a hole formed in a clevis 160 at the end of the second shaft portion 152. In this configuration, when it is time to break down the shafts 150 and 152, the pin 158 can be pulled from this connection so as to allow the shaft portions 150 and 152 to be separated.

FIG. 9 shows another alternative embodiment 170 of the table umbrella apparatus of the present invention. In this table umbrella apparatus, a motor 172 is mounted to the top of the hub 174 at the top of the tubular support member 176. As such, the motor 172 will directly rotate the hub 174 for the rotation of the fan blades 178. A cord 180 will extend through the base 182 and through the interior of the tubular support member 176 so as to provide power for the motor 172.

Figure 10:
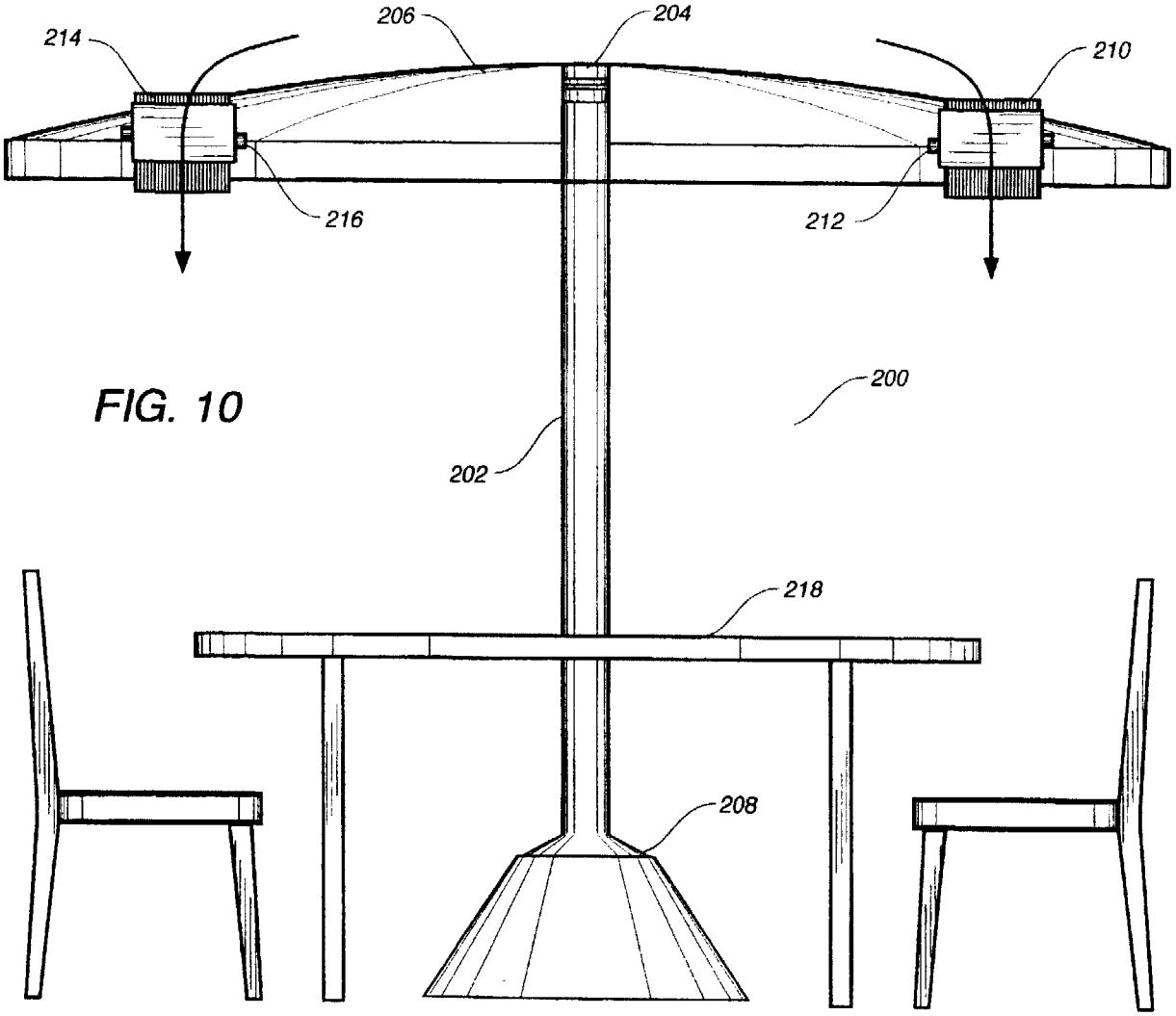
FIG. 10 is a diagrammatic side elevational view of a fourth alternative embodiment of the table umbrella apparatus of the present invention.

FIG. 10 shows another alternative embodiment 200 of the table umbrella apparatus of the present invention. The table umbrella apparatus 200 is a less expensive, yet workable, version of the table umbrella apparatus as shown in the previous embodiments of the present invention. As can be seen in FIG. 10, the table umbrella apparatus 200 has a tubular support member 202, a hub 204, a fan 206 and a rotation means 208. Importantly, the table umbrella apparatus 200 includes a disk 206 as the fan of the present invention. The disk 206 can be made out of fiberglass or plastic which is attached to the rotating hub. Importantly, a vent 210 is fixed to the disk 206 so as to pass air downwardly through the disk 206. In particular, the vent 210 is connected to the disk 206 at hinges 212. The hinges 212 allow the vent 210 to be angularly adjusted so as to control the amount and the angle of air passing downwardly through the disk 206. A second vent 214 is adjustably hingedly connected to the disk 206 approximately 180° removed from the first vent 210. The second vent 214 is also hingedly connected at hinges 216 to the disk 206. The hinged connection of the vent 214 to the disk 206 allows the user to adjust the pitch of the vent 214 so as to control the downward air flow through the vent 214. The rotation of the disk 206 is carried out in a similar manner as with the previous embodiments. In particular, the motor 208 will control the rotation of a shaft on the interior of tubular support member 202 so as to properly rotate the hub 204. The disk 206 will rotate in correspondence with the rotation of the hub. As the disk 206 rotates, air is drawn through the vents 210 and 214 downward toward the table 218 of the table umbrella apparatus 200 of this alternative embodiment of the present invention.

Figure 11:
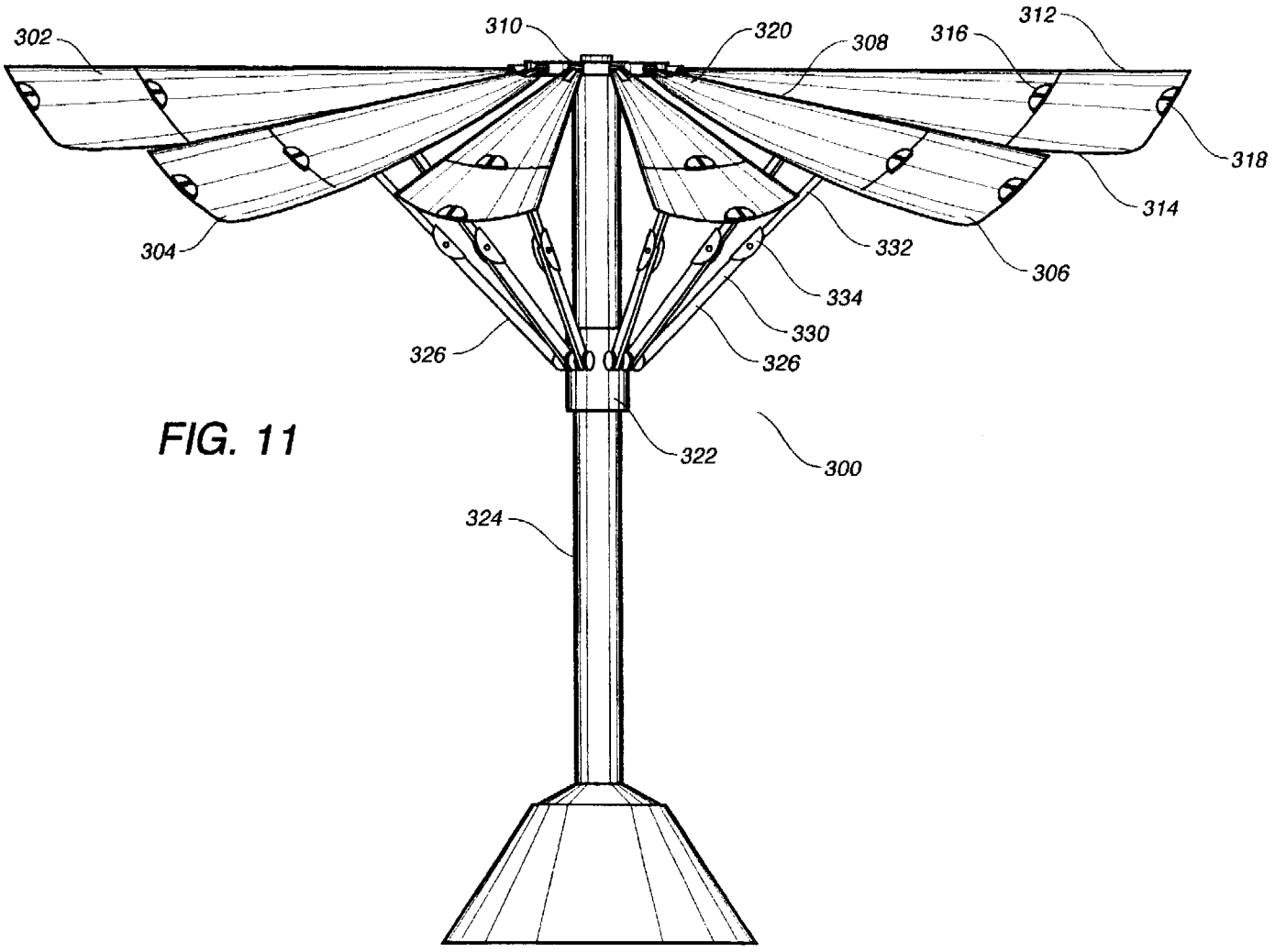
FIG. 11 is a side elevational view of an alternative configuration of the fan blades of the table umbrella apparatus of the present invention.

FIG. 11 shows a third alternative embodiment 300 of the table umbrella apparatus of the present invention. The table umbrella apparatus 300 includes a plurality of fan blades 302, 304, 306 and 308. Each of the fan blades 302, 304, 306 and 308 is hingedly connected to the hub 310. Each of the fan blades 302, 304, 306 and 308 is made up of a first wire frame member 312 and a second wire frame member 314. Each of the wire frame members 312 and 314 is hingedly connected to the hub 310. Importantly, a first locking hinge 316 and a second locking hinge 318 extend between the wire frame members 312 and 314. The hinges 316 and 318 serve to fixedly separate the first wire frame member 312 from the second wire frame member 314 when the locking hinges 316 and 318 are fully extended outwardly. A covering 320 stands between the first wire frame member 312 and the second wire frame member 314. The locking hinge members 316 and 318 are collapsible in one direction so as to allow each of the blades 302, 304, 306, and 308 to fold enough so as to lay parallel to the support bracket when in the closed position.

As can be seen in FIG. 11, a tubular support bracket 322 is slidably disposed over the exterior surface of the tubular support member 324. The tubular bracket 322 has a plurality of struts 326 hingedly connected thereto. Each of the plurality of struts 326 is also hingedly connected to one of the plurality of fan blades 302, 304, 306 and 308. Each of the plurality of struts 326 includes a first strut segment 330 and a second strut segment 332. The first strut segment is hingedly connected at one end to the tubular support bracket 322. The second strut segment 332 is hingedly connected at one end to one of the plurality of fan blades. A locking hinge 334 is connected to an opposite end of the first strut segment 330 and to an opposite end of the second strut segment 332. The locking hinge 334 serves to linearly align the first strut segment 330 with the second strut segment 332 so as to fix the first and second strut segments in linear alignment. The locking hinge 334 is collapsible so as to allow each of the fan blades 302, 304, 306 and 308 to be collapsed against the outer surface of the tubular support member 324. The tubular support bracket 322 is freely rotatable around the outer surface of the tubular support member 324. The support bracket 322 is locked into an upright position by raising the fan blades 302, 304, 306 and 308 past a catch point. To release or lower the blades, it is necessary to push a release button located on the bracket 322 or to lift the blades again pass a point where the catch releases and the bracket collapses and the blades fold parallel to the tubular support member 324. As can be seen, this configuration allows the the blades to have the ability to collapse much like a common umbrella.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. An apparatus comprising:

a tubular support member, a hub rotatably mounted on said tubular support member;

a fan means comprising a plurality of fan blades extending radially outwardly of said hub, said fan means being in a shape of an umbrella, wherein a downward draft of air is produced during rotation of said fan means;

a base connected to a bottom of said tubular support member, said base supporting said tubular support member in a vertical orientation;

a shaft connected to a rotation means at one end and connected to said hub at an opposite end, said shaft being supported by bearings interior of said tubular support member; said shaft extending longitudinally along an interior of said tubular support member;

said rotation means being connected to said hub for automatically rotating said fan means around a longitudinal axis of said tubular support member; said rotation means comprising:

a motor mounted in said base; and transmission means interconnecting said motor to said shaft, said shaft extending into said base; said transmission means comprising:

I. a pulley connected to said motor by a drive belt, ii. a worm gear extending axially outwardly from said pulley, said worm gear rotatable with a rotation of said pulley, and iii. a drive gear in toothed connection with said worm gear, said drive gear connected to said shaft such that said shaft extends axially upwardly therefrom, said drive gear rotatable relative to a movement of said worm gear; and a table supported around said tubular support member, said table extending radially in a horizontal plane from said tubular support member, said table positioned below said fan means.

2. The apparatus of claim 1, said shaft comprising:

a first shaft portion connected to said rotation means at one end; and a second shaft portion connected to said hub at one end, said second shaft portion in clutched connection with said first shaft portion.

3. The apparatus of claim 1, said tubular support member comprising:

a first tubular member; and a second tubular member telescopically connected to an end of said first tubular member, one of said first and second tubular members having a greater diameter than the other of said first and second tubular members.

4. The apparatus of claim 3, said tubular support member further comprising:

a connecting pin affixed to one of said first and second tubular members and removably received within a hole in the other of said first and second tubular members, said hole extending through a wall of said other of said first and second tubular members.

5. The apparatus of claim 1, said motor comprising:

an AC motor having a drive shaft connected to said drive belt; and a power supply cord means connected to said AC motor and extending outwardly of said base, said power supply cord means for connection to a power supply source.

6. The apparatus of claim 1, each of said plurality of fan blades comprising:

a wire frame having one end connected to said hub and extending outwardly therefrom; and a covering extending over said wire frame.

7. The apparatus of claim 6, said wire frame being hingedly connected to said hub, each of said plurality of fan blades further comprising:

an eyelet mounted to said wire frame and extending outwardly of said cover; and a support cable means connected at one end to said hub and detachably connected to said eyelet at another end, said support cable means for supporting said plurality of fan blades in an open umbrella fashion with respect to said tubular support member.

8. The apparatus of claim 1, said plurality of fan blades selectively movable between an open position extending radially outwardly of said hub and a closed position adjacent said tubular support member.

9. The apparatus of claim 8, said transmission means comprising:

a pulley connected to said motor by a drive belt;

a worm gear extending axially outwardly from said pulley, said worm gear rotatable with a rotation of said pulley; and a drive gear in toothed connection with said worm gear, said drive gear connected to said shaft such that said shaft extends axially upwardly therefrom, said drive gear rotatable relative to a movement of said worm gear.

* * * * *